US007694779B2

(12) United States Patent
Takayasu et al.

(10) Patent No.: US 7,694,779 B2
(45) Date of Patent: Apr. 13, 2010

(54) SOUND ABSORBING MATERIAL

(75) Inventors: Akira Takayasu, Kakamigahara (JP); Tsutomu Yamamoto, Otsu (JP); Kazuhiko Kosuge, Tokyo (JP); Mineaki Matsumura, Osaka (JP)

(73) Assignees: Takayasu Co., Ltd., Gifu (JP); Du Pont-Toray Company, Ltd., Tokyo (JP); Ichimura Sangyo Co., Ltd., Osaka (JP)

( * ) Notice: Subject to any disclaimer, the term of this patent is extended or adjusted under 35 U.S.C. 154(b) by 135 days.

(21) Appl. No.: 10/567,684

(22) PCT Filed: Aug. 24, 2004

(86) PCT No.: PCT/JP2004/012104

§ 371 (c)(1),
(2), (4) Date: Apr. 6, 2006

(87) PCT Pub. No.: WO2005/019783

PCT Pub. Date: Mar. 3, 2005

(65) Prior Publication Data

US 2006/0225952 A1 Oct. 12, 2006

(30) Foreign Application Priority Data

Aug. 25, 2003 (JP) ..... 2003-300449
Dec. 25, 2003 (JP) ..... 2003-430652
Apr. 7, 2004 (JP) ..... 2004-113405

(51) Int. Cl.
*E04B 1/84* (2006.01)

(52) U.S. Cl. ..... 181/294; 181/290; 181/286; 442/388

(58) Field of Classification Search ..... 181/290, 181/294, 286; 442/338, 388
See application file for complete search history.

(56) References Cited

U.S. PATENT DOCUMENTS 3,476,636 A * 11/1969 Crosby ..... 428/92
4,194,037 A * 3/1980 Stoller ..... 428/92
4,432,433 A * 2/1984 Ogawa ..... 181/204
4,490,425 A * 12/1984 Knoke et al. ..... 428/90
4,780,359 A * 10/1988 Trask et al. ..... 442/224
4,957,794 A * 9/1990 Bair ..... 428/74

(Continued)

FOREIGN PATENT DOCUMENTS

JP 52-63404 5/1977

(Continued)

OTHER PUBLICATIONS

English translation of JP 2002-079598, published Mar. 2002. (JP '598 was previously cited in IDS filed Feb. 9, 2006.).

(Continued)

*Primary Examiner*—Jeffrey Donels
*Assistant Examiner*—Forrest M Phillips
(74) *Attorney, Agent, or Firm*—Wenderoth, Lind & Ponack, L.L.P.

(57) ABSTRACT

A sound-absorbing material, wherein a non-woven fabric with a mass per unit area of 150 to 800 g/m$^2$ and a bulk density of 0.01 to 0.2 g/cm$^3$ and a surface material with an air permeability of not more than 50 cc/cm$^2$/sec measured according to JIS L-1096 are layered.

22 Claims, 2 Drawing Sheets

1 : a surface material
2 : a non-woven fabric

U.S. PATENT DOCUMENTS

| | | | | | |
|---|---|---|---|---|---|
| 4,980,233 | A | * | 12/1990 | McCullough et al. | 428/411.1 |
| 5,035,298 | A | * | 7/1991 | Noxon | 181/295 |
| 5,068,001 | A | * | 11/1991 | Haussling | 156/222 |
| 5,279,878 | A | * | 1/1994 | Fottinger et al. | 428/102 |
| 5,317,113 | A | * | 5/1994 | Duda | 181/285 |
| 5,459,291 | A | * | 10/1995 | Haines et al. | 181/286 |
| 5,585,185 | A | * | 12/1996 | Smith et al. | 428/411.1 |
| 5,665,447 | A | * | 9/1997 | Greaves et al. | 428/68 |
| 5,755,900 | A | * | 5/1998 | Weir et al. | 156/62.2 |
| 5,766,745 | A | * | 6/1998 | Smith et al. | 428/218 |
| 5,824,973 | A | * | 10/1998 | Haines et al. | 181/286 |
| 5,945,643 | A | * | 8/1999 | Casser | 181/290 |
| 6,034,009 | A | * | 3/2000 | Sato | 442/388 |
| 6,102,465 | A | * | 8/2000 | Nemoto et al. | 296/39.3 |
| 6,123,171 | A | * | 9/2000 | McNett et al. | 181/290 |
| 6,123,172 | A | * | 9/2000 | Byrd et al. | 181/290 |
| 6,235,658 | B1 | * | 5/2001 | Panzer et al. | 442/62 |
| 6,296,076 | B1 | * | 10/2001 | Hiers et al. | 181/290 |
| 6,345,688 | B1 | * | 2/2002 | Veen et al. | 181/290 |
| 6,489,256 | B1 | * | 12/2002 | Kent et al. | 442/302 |
| 6,756,332 | B2 | * | 6/2004 | Sandoe et al. | 442/344 |
| 6,946,196 | B2 | * | 9/2005 | Foss | 428/373 |
| RE39,260 | E | * | 9/2006 | Byrd et al. | 181/290 |
| 7,178,630 | B1 | * | 2/2007 | Perdue | 181/290 |
| 2001/0036788 | A1 | * | 11/2001 | Sandoe et al. | 442/389 |
| 2002/0197442 | A1 | * | 12/2002 | Wyner et al. | 428/85 |
| 2003/0077969 | A1 | | 4/2003 | Tanaka | |
| 2003/0220036 | A1 | * | 11/2003 | Lee et al. | 442/153 |
| 2004/0048036 | A1 | * | 3/2004 | Nakasuji et al. | 428/95 |
| 2004/0189042 | A1 | * | 9/2004 | Jarrard et al. | 296/136.01 |
| 2005/0170732 | A1 | * | 8/2005 | Knoff | 442/381 |
| 2005/0249931 | A1 | * | 11/2005 | Utsumi | 428/218 |
| 2005/0255287 | A1 | * | 11/2005 | Komuro et al. | 428/113 |
| 2006/0035555 | A1 | * | 2/2006 | Narayanan et al. | 442/387 |
| 2006/0137799 | A1 | * | 6/2006 | Haque et al. | 156/62.2 |
| 2006/0141884 | A1 | * | 6/2006 | Haque | 442/361 |
| 2006/0225952 | A1 | * | 10/2006 | Takayasu et al. | 181/294 |
| 2006/0289230 | A1 | * | 12/2006 | Connelly et al. | 181/290 |
| 2006/0289231 | A1 | * | 12/2006 | Priebe et al. | 181/290 |
| 2007/0007062 | A1 | * | 1/2007 | Ogawa et al. | 180/69.23 |
| 2007/0144829 | A1 | * | 6/2007 | Ishikawa et al. | 181/286 |

FOREIGN PATENT DOCUMENTS

| | | | | |
|---|---|---|---|---|
| JP | 06-212545 | | | 8/1994 |
| JP | 7-9610 | | | 1/1995 |
| JP | 9-324357 | | | 12/1997 |
| JP | 10-121361 | | | 5/1998 |
| JP | 10-333684 | | | 12/1998 |
| JP | 11-286065 | | | 10/1999 |
| JP | 2001-271438 | | | 10/2001 |
| JP | 2002-79598 | | | 3/2002 |
| JP | 2002-182655 | | | 6/2002 |
| JP | 2002-200681 | | | 7/2002 |
| JP | 2003049351 | A | * | 2/2003 |
| JP | 2003-82568 | | | 3/2003 |
| JP | 2003-216161 | | | 7/2003 |
| JP | 2004143632 | A | * | 5/2004 |
| JP | 2004145180 | A | * | 5/2004 |
| JP | 2004354844 | A | * | 12/2004 |
| JP | 2005263118 | A | * | 9/2005 |
| JP | 2005307109 | A | * | 11/2005 |
| JP | 2005335279 | A | * | 12/2005 |
| JP | 2006098890 | A | * | 4/2006 |
| JP | 2007086505 | A | * | 4/2007 |
| RU | 2 023 084 | | | 11/1994 |

OTHER PUBLICATIONS

Notification of the First Office Action for corresponding Chinese Application No. 200480024451.3 issued Dec. 14, 2007, with English translation.

Official Action for corresponding Russian Application No. 2006109476/28(010308) issued Jul. 28, 2008, with English translation.

First Examination Report for corresponding Indian Application No. 619/KOLNP/2006 issued Jul. 1, 2008, with English translation.

Decision on Grant issued on Nov. 1, 2008 in corresponding Russian Application No. 2006109476, with English translation.

Enohara, English Translation of Japanese Publication No. 2003-049351, Published Feb. 21, 2003.

* cited by examiner

1 : a surface material
2 : a non-woven fabric

1 : a surface material
2 : a non-woven fabric

SOUND ABSORBING MATERIAL

This application is a U.S. National Stage of International Application No. PCT/JP2004/012104 filed Aug. 24, 2004.

TECHNICAL FIELD

The present invention relates to a sound-absorbing material, more particularly to a sound-absorbing material to be used in the fields of, for example, electric products such as air conditioners, electric refrigerators, electric washing machines, and electric lawn mowers; transport facilities such as vehicles, boats and ships, and airplanes; or building materials such as building wall materials, and civil engineering/construction machineries.

BACKGROUND ART

Sound-absorbing materials are conventionally used for, for example, electric products, building wall materials, and vehicles. Particularly, for the purpose of preventing vehicles such as cars from generating exterior acceleration noise or exterior idling noise, specifications requiring that engines and transmissions be surrounded with acoustic shields are being adopted. Generally, in the case of cars, such acoustic shields need not only to have excellent sound absorbency but also to prevent the spread of fire to a driver seat in the event that a fire breaks out in an engine room due to a traffic accident, in view of securing safety. Accordingly, from the viewpoint of fire prevention, there has been a demand for a flame-retardant sound-absorbing material excellent in not only sound absorbency but also fire safety. In addition, it is also desired that such a flame-retardant sound-absorbing material should not produce a toxic gas when burned.

In addition to having sound absorbency and flame retardancy, it is desired that sound-absorbing materials for vehicles such as cars should be made of light and recyclable materials to achieve the weight reduction of cars and to promote recycled use of sound-absorbing materials of scrap cars. This is because promotion of recycled use of various parts of scrap cars to reduce the amount of industrial waste from scrap cars as much as possible is considered important for prevention of pollution.

For these reasons described above, light and flame-retardant non-woven fabrics are receiving attention as materials satisfying the above requirements. Generally, flame-retardant non-woven fabrics are manufactured by, for example, using flame-retardant fibers such as aramid fibers and polychlal fibers as main constituent synthetic fibers of non-woven fabrics, or using synthetic fibers in which a phosphoric acid-based flame retardant or a boric acid-based flame retardant is blended, or coating or impregnating sheet-like non-woven fabrics with a binder coating solution in which a flame retardant is dispersed.

For example, Japanese Patent Application Laid-open Nos. 62-43336 and 62-43337 disclose an interior material for vehicles manufactured by applying a vinyl chloride emulsion onto the surface of a non-woven fabric mat obtained by needle-punching a web comprised of 95 wt % of a polyester fiber, a polypropylene fiber, or a mixture thereof and 5 wt % of a rayon fiber, drying it to form a flame-retardant resin coating, and laminating a glass fiber mat on the resin-coated surface of the non-woven fabric mat to unite the glass fiber mat with the non-woven fabric mat. Such an interior material for vehicles is excellent in flame retardancy but poor in recyclability because the non-woven fabric mat is united with the glass fiber mat. Further, the interior material for vehicles has a problem in that there is a fear that the interior material produces dioxin when incinerated.

Further, Japanese Patent Application Laid-open No. 9-59857 discloses a flame-retardant non-woven fabric manufactured by laminating non-woven web layers of a flame-retardant staple fiber on both of the surfaces of non-woven web layers of a polyester fiber in such a manner that the amount of the non-woven web layers of the flame-retardant staple fiber becomes 50 wt % or more of the total amount of a resultant non-woven fabric, and intertwining the constituent fibers with each other between adjacent web layers. Japanese Patent Application Laid-open No. 2002-348766 discloses a flame-retardant sheet material manufactured by needle-punching a web obtained by blending a polyester fiber with a flame-retardant rayon fiber or modacrylic fiber (that is obtained by copolymerizing acrylonitrile with a vinyl chloride-based monomer as a flame retardant) and further stitch-bonding it. Japanese Patent Application Laid-open No. 2000-328418 discloses a halogen-free flame-retardant non-woven fabric manufactured by binding a fiber web containing a cellulose-based fiber, a polyvinyl alcohol-based fiber, and a phosphorus-based flame-retardant polyester fiber with an acrylic resin binder. These non-woven fabrics disclosed in the above patent documents are excellent in flame retardancy but poor in sound absorbency.

As an example of a flame-retardant sound-absorbing material, Japanese Patent Application Laid-open No. 2002-287767 discloses a sound-absorbing material for vehicles manufactured by coating and integrally molding a mat-like sound-absorbing material, in which rock wool, a glass fiber and a polyester fiber are irregularly oriented in a mixed state and these fibers are bound together with a fibrous binder such as a low-melting point polyester fiber, and a surface material which is comprised of a polyester fiber-based non-woven fabric subjected to water-, oil-, and flame-proof treatment. Further, Japanese Patent Application Laid-open No. 2002-161465 discloses a sound-absorbing material manufactured by laminating a flame-retardant polyester filament non-woven fabric as a surface material on one surface of a laminate structure comprising a meltblown non-woven fabric and a polyester non-woven fabric united by needle-punching.

In both of the above techniques, these flame-retardant sound-absorbing materials are manufactured by uniting a sound-absorbing material with a flame-retardant surface material. According to the former techniques, as described above, since the mat-like sound-absorbing material and the surface material coating the sound-absorbing material are integrally molded, it is necessary to carry out thermocompression molding at a temperature of a melting point of the fibrous binder or higher, which complicates the manufacturing process thereof. Further, in a case where the polyester fiber contains a halogen-based flame retardant, there is a fear that the sound-absorbing material produces a toxic gas when burned. On the other hand, the sound-absorbing materials according to the latter techniques have a drawback that flame retardancy is poor.

BRIEF DESCRIPTION OF THE DRAWINGS

FIG. 2B shows a sound-absorbing material according to the present invention, wherein the non-woven fabric (2) is in the shape of a cylinder. In the sound-absorbing materials shown by FIGS. 2A and 2B, the surface material (1) is layered on the curved face of the column or the cylinder.

DISCLOSURE OF THE INVENTION

Figure 1:
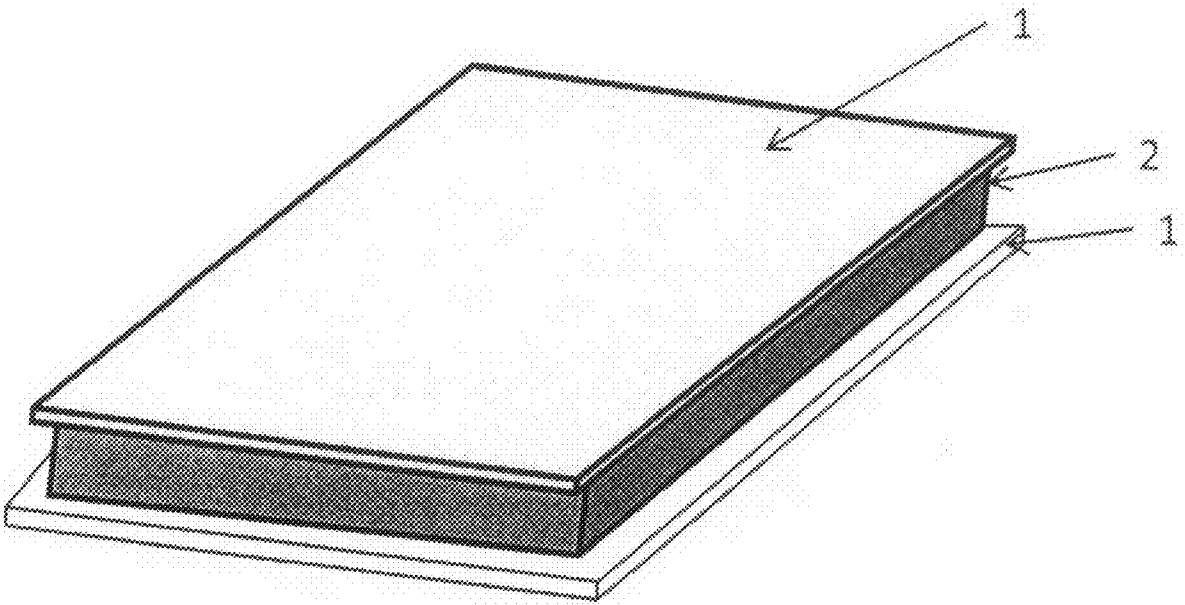
FIG. 1 shows a sound-absorbing material according to the present invention, wherein the non-woven fabric (2) is in the shape of a polyhedron (hexahedron) and the surface material (1) is layered on two (both side) faces of the polyhedron (hexahedron).
Figure 2:
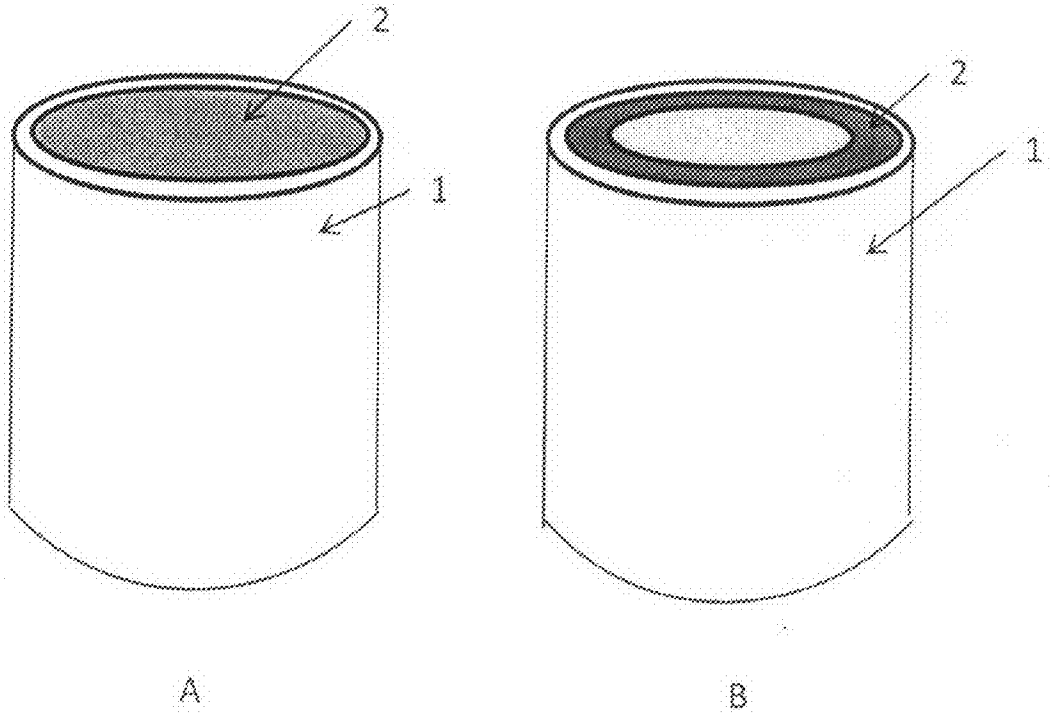
FIG. 2 A shows a sound-absorbing material according to the present invention, wherein the non-woven fabric (2) is in the shape of a column.

In view of the problems described above, it is an object of the present invention to provide a sound-absorbing material which is advantageous in sound absorbency, has flame retardancy without using a flame retardant, produces no drip of a liquid molten material when a constituent fiber is melted, has low shrinkability, and is excellent in safety, cost efficiency and recyclability.

In order to achieve the above object, the present inventors have intensively investigated, and as a result they have found that by layering a surface material having an air permeability of not more than 50 cc/cm$^2$/sec measured according to JIS L-1096 onto a non-woven fabric with a mass per unit area of 150 to 800 g/m$^2$ and a bulk density of 0.01 to 0.2 g/cm$^3$, especially such a non-woven fabric obtained by intertwisting fibers by needle-punching or water jet punching rather than by thermal fusion, it is possible to obtain a sound-absorbing material excellent in sound absorbency, flame retardancy, recyclability, and workability. This finding has led to the completion of the present invention.

Specifically, the present invention is directed to a sound-absorbing material having a layer structure comprising a non-woven fabric with a mass per unit area of 150 to 800 g/m$^2$ and a bulk density of 0.01 to 0.2 g/cm$^3$ and a surface material with an air permeability of not more than 50 cc/cm$^2$/sec measured according to JIS L-1096.

In the sound-absorbing material of the present invention, the non-woven fabric is preferably a fabric in which a thermoplastic staple fiber and a heat-resistant staple fiber with an LOI value of not less than 25 are intertwisted together. The mass ratio of the thermoplastic staple fiber and the heat-resistant staple fiber is more preferably in a range of 95:5 to 55:45, most preferably in a range of 85:15 to 55:45. The sound-absorbing material having such a structure is a flame-retardant sound-absorbing material excellent in flame retardancy as well as sound absorbency.

Further, in the sound-absorbing material of the present invention, the thermoplastic staple fiber is preferably at least one kind of staple fibers selected from the group consisting of a polyester fiber, a polypropylene fiber and a nylon fiber, and the heat-resistant staple fiber is preferably at least one kind of staple fibers selected from the group consisting of an aramid fiber, a polyphenylene sulfide fiber, a polybenzoxazole fiber, a polybenzothiazole fiber, a polybenzimidazole fiber, a polyether ether ketone fiber, a polyarylate fiber, a polyimide fiber, a fluoride fiber, and a flame-resistant fiber. More preferably, the thermoplastic staple fiber is a polyester staple fiber and the heat-resistant staple fiber is an aramid staple fiber.

Furthermore, in the sound-absorbing material of the present invention, the surface material is preferably a spun-bonded filament non-woven fabric or a wet-laid staple fiber non-woven fabric. The non-woven fabric and the surface material may be comprised of the same kind of synthetic fiber.

Moreover, in the sound-absorbing material of the present invention, the surface material is preferably a wet-laid non-woven fabric comprised of a heat-resistant fiber with an LOI value of not less than 25 or a wet-laid non-woven fabric comprised of a heat-resistant fiber with an LOI value of not less than 25 and a silicate mineral (e.g., mica). By using such a wet-laid non-woven fabric as the surface material, it is possible to obtain a sound-absorbing material excellent in sound absorbency and flame resistance.

Moreover, in the sound-absorbing material of the present invention, as the surface material is also preferably used a clean paper with not more than 500 dust particles with a particle diameter of not less than 0.3 μm per 0.1 ft$^3$ when subjected to measurement by the tumbling method according to JIS B-9923 6.2(1.2). By using such clean paper as the surface material, it is possible to obtain a sound-absorbing material which is excellent in sound absorbency and flame retardancy, and has low dust generation properties.

Moreover, the non-woven fabric and the surface material are preferably layered together in a state where they are bonded together. In this case, the number of bonding points of the non-woven fabric and the surface material is preferably not more than 30 points/cm$^2$, and the ratio of the total surface area of the bonding points to the total surface area of the bonding points and non-bonding points is preferably not more than 30%.

Moreover, in the sound-absorbing material of the present invention, the non-woven fabric may be in the shape of a polyhedron or a column or a cylinder having curved surface. In the former case, the surface material can be layered on two or more faces of the polyhedron. In the latter case, the surface material can be layered on the curved surface of the columnar or the cylinder. For example, a sound-absorbing material in which the surface material is layered on both surfaces of a hexahedral non-woven fabric (e.g., a rectangular parallelepiped non-woven fabric) can be mentioned. The sound-absorbing material having such a structure is improved in sound transmission loss so that sound insulation as well as sound absorbency is improved.

Moreover, in the present invention, the sound-absorbing material may have a multilayer structure comprising one or more layers of the non-woven fabric and one or more layers of the surface material, wherein these layers are united with each other. The sound-absorbing material having such a structure is improved in sound absorbency at low frequencies.

The above-described sound-absorbing material can be suitably used as a sound-absorbing material for vehicle interior or exterior materials, lawn mowers, and breakers.

EFFECT OF THE INVENTION

According to the present invention, it is possible to provide a sound-absorbing material excellent in sound absorbency (e.g., normal incidence sound absorption coefficients, sound absorption coefficients in reverberation chamber), flame retardancy, recyclability, and workability at low cost. In addition, the use of a non-woven fabric obtained by intertwisting a thermoplastic staple fiber with a heat-resistant staple fiber makes it possible to provide a high-safety sound-absorbing material which produces no drip of a liquid molten material when the constituent fibers are melted, has low shrinkability, and produces no toxic gas when burned.

BEST MODE FOR CARRYING OUT THE INVENTION

A sound-absorbing material according to the present invention has a layer structure comprising a non-woven fabric with a mass per unit area of 150 to 800 g/m$^2$and a bulk density of 0.01 to 0.2 g/cm$^3$ and a surface material with an air permeability of not more than 50 cc/cm$^2$/sec measured according to JIS L-1096.

The non-woven fabric to be used in the present invention may be either a staple fiber non-woven fabric or a filament non-woven fabric as long as it has a mass per unit area of 150 to 800 g/m$^2$ and a bulk density of 0.01 to 0.2 g/cm$^3$. Examples of such a non-woven fabric include needle-punched non-woven fabrics, water jet punched non-woven fabrics, melt-blown non-woven fabrics, spunbonded non-woven fabrics, and stitch-bonded non-woven fabrics. Among them, needle-punched non-woven fabrics and water jet punched non-woven fabrics are preferably used, and needle-punched non-woven fabrics are particularly preferably used. Crude felt can also be used as the non-woven fabric.

In the present invention, the cross-sectional shape of a constituent fiber of the non-woven fabric is not particularly limited, and the constituent fiber may have either a perfect circular cross-sectional shape or a modified cross-sectional shape. Examples of the modified cross-sectional shape include oval, hollow, X, Y, T, L, star, leaf (e.g., trefoil, quatrefoil, cinquefoil), and other polyangular (e.g., triangular, quadrangular, pentangular, hexangular) shapes.

Further, in the present invention, the constituent fiber of the non-woven fabric is a natural fiber or a synthetic fiber, but a synthetic fiber is preferably used from the viewpoint of durability. Examples of the synthetic fiber include thermoplastic fibers such as a polyester fiber, a polyamide fiber (e.g., a nylon fiber), an acrylic fiber, and a polyolefin fiber (e.g., a polypropylene fiber, a polyethylene fiber). Such fibers can be manufactured from raw materials thereof according to a well-known method such as wet spinning, dry spinning, or melt spinning. Among these synthetic fibers, a polyester fiber, a polypropylene fiber, and a nylon fiber are preferably used because they are excellent in durability and abrasion resistance. Particularly, a polyester fiber is most preferably used because a raw material thereof, that is, polyester can be obtained by thermally melting used polyester non-woven fabrics and the thus obtained polyester can be easily recycled, and therefore a polyester fiber can be economically manufactured. In addition, non-woven fabrics made of a polyester fiber have good texture and moldability. Such thermoplastic fibers may be partially or entirely made of a reused material (recovered and regenerated fibers). Particularly, fibers recycled from recovered fibers once used for vehicle interior or exterior materials can be suitably used.

The polyester fiber described above is not particularly limited as long as it is made of a polyester resin. Such a polyester resin is not particularly limited as long as it is a polymer resin which comprises repeating units containing ester linkages, and may be one which comprises ethylene terephthalate as a main repeating units of a dicarboxylic acid component and a glycol component. Alternatively, the polyester fiber may be a biodegradable polyester fiber made of polycaprolactone, polyethylene succinate, polybutylene succinate, polyethylene adipate, polybutylene adipate, polyethylene succinate/adipate copolymer or polylactic acid, or a polyester fiber synthesized by copolymerizing such a polyester as a main component with another dicarboxylic acid and/or glycol. Examples of the dicarboxylic acid component include terephthalic acid, 2,6-naphthalene dicarboxylic acid, isophthalic acid, and 1,4-cyclohexane dicarboxylic acid. Examples of the glycol component include ethylene glycol, propylene glycol, tetramethylene glycol, 1,3-propanediol, 1,4-butanediol, and 1,4-cyclohexanedimethanol. The dicarboxylic acid component can be partially replaced by adipic acid, sebacic acid, dimer acid, sulfonic acid, or metal-substituted isophthalic acid. Further, the glycol component can be partially replaced by diethylene glycol, neopentyl glycol, 1,4-cyclohexanediol, 1,4-cyclohexanedimethanol, or polyalkylene glycol.

The polyester fiber is generally manufactured using a polyester resin according to a well-known spinning method such as melt spinning. Examples of such a polyester fiber include a polyethylene terephthalate (PET) fiber, a polybutylene terephthalate (PBT) fiber, a polyethylenephthalate (PEN) fiber, a polycyclohexylenedimethylene terephthalate (PCT) fiber, a polytrimethylene terephthalate (PTT) fiber, and a polytrimethylene naphthalate (PTN) fiber. Among them, a polyethylene terephthalate (PET) fiber is preferably used. The polyethylene terephthalate fiber may contain, for example, conventional antioxidants, chelating agents, ion-exchange agents, color protection agents, waxes, silicone oil, or various surfactants as well as particles such as various inorganic particles e.g., titanium oxide, silicon oxide, calcium carbonate, silicon nitride, clay, talc, kaolin, and zirconium acid, cross-linked polymer particles, and various metal particles. The polypropylene fiber is not particularly limited as long as it is made of a polypropylene resin. The polypropylene resin is not particularly limited as long as it is a polymer resin which comprises repeating units containing the following structure: —$CH(CH_3)CH_2$—. Examples of such a polypropylene resin include polypropylene resins and propylene-olefin copolymer resins such as a propylene-ethylene copolymer resin. The polypropylene fiber is manufactured using such a polypropylene resin according to a well-known spinning method such as melt spinning. Further, the polypropylene fiber may contain the above-mentioned various additives that can be added to the polyester fiber.

Examples of the nylon fiber include fibers made of nylon resins or nylon copolymer resins such as polycaproamide (nylon 6), polyhexamethylene adipamide(nylon 66), polytetramethyle aendipamide (nylon 46), polyhexamethylene sebacamide (nylon 610), polyhexamethylene dodecamide (nylon 612), polyundecanamide (nylon 11), polydodecanamide (nylon 12), poly(m-xylene adipamide) (nylon MXD6), polyhexamethylene terephthalamide (nylon 6T), polyhexamethylene isophthalamide (nylon 6I), polyxylylene adipamide (nylon XD6), polycaproamide/polyhexamethylene terephthalamide copolymer (nylon 6/6T), polyhexamethylene adipamide/polyhexamethylene terephthalamide copolymer (nylon 66/6T), polyhexamethylene adipamide/polyhexamethylene isophthalamide copolymer (nylon 66/6I), polyhexamethylene adipamide/polyhexamethylene isophthalamide/polycaproamide copolymer (nylon 66/6I/6), polyhexamethyleneterephthalamide/polyhexamethyleneisophthal amide copolymer (nylon 6T/6I), polyhexamethylene terephthalamide/polydodecanamide copolymer (nylon 6T/12), polyhexamethylene adipamide/polyhexamethylene terephthalamide/polyhexamethylene isophthalamide copolymer (nylon 66/6T/6I), and polyhexamethylene terephthalamide/poly-2-methylpentamethylene terephtalamide copolymer (nylon 6T/M5T). The nylon fiber is manufactured using such a nylon resin according to a well-known method such as melt spinning. Further, the nylon fiber may contain the above-mentioned additives that can be added to the polyester fiber.

The fiber length and fineness of the thermoplastic fiber are not particularly limited, and are appropriately determined according to compatibility with other synthetic fibers or the uses of resultant flame-retardant non-woven fabrics. However, the fiber length of the thermoplastic fiber is preferably 10 mm or longer. The thermoplastic fiber may be either a filament or a staple fiber. In the case of a staple fiber, the fiber length is preferably 10 to 100 mm, particularly preferably 20 to 80 mm. By intertwisting a staple fiber having a fiber length of 10 mm or longer to manufacture a non-woven fabric, it is possible to prevent the staple fiber from dropping off the non-woven fabric. A longer fiber length makes sound absorbency of the non-woven fabric better, but tends to make spinnability (e.g., by a carding machine) and flame retardancy poor. Therefore, the fiber length of the thermoplastic staple fiber is preferably 100 mm or less. The fineness of the thermoplastic fiber is 0.5 to 30 dtex, preferably 1.0 to 20 dtex, particularly preferably 1.0 to 10 dtex.

The thermoplastic staple fibers mentioned above can be used alone or in combination of two or more types of them. For example, the thermoplastic staple fibers that are the same type but are different in fineness or fiber length may be mixed or the thermoplastic staple fibers that are different in type as well as in fineness or fiber length may be mixed. In either case, the mixing ratio of these staple fibers is not particularly limited, and can be appropriately determined according to the uses or purposes of the resultant non-woven fabrics.

In order to obtain a more flame-retardant non-woven fabric, the thermoplastic staple fiber is preferably intertwisted and united with a heat-resistant staple fiber. The heat-resistant staple fiber has an LOI (limiting oxygen index) value of not less than 25, and does not include fibers that are rendered flame retardant by adding a flame retardant, such as a flame-retardant rayon fiber, a flame-retardant vinylon fiber, and a modacrylic fiber. Here, an LOI value means the minimum oxygen concentration required to sustain combustion of 5 cm or more of a sample, and is measured according to JIS L 1091. By using such a heat-resistant staple fiber having an LOI value of not less than 25, it is possible to impart flame retardancy to the non-woven fabric. However, in order to obtain an even more flame-retardant non-woven fabric, a heat-resistant staple fiber having an LOI value of not less than 28 is preferably used.

The heat-resistant staple fiber to be preferably used in the present invention is superior to the thermoplastic staple fiber in that it has low shrinkability, and therefore a resultant non-woven fabric is not easily melted and shrunk when burned. Particularly, such a heat-resistant staple fiber preferably has a dry heat shrinkage of not more than 1% at 280° C. Specific examples of such a heat-resistant staple fiber include staple fibers obtained by, for example, cutting at least one type of heat-resistant organic fibers selected from the group consisting of an aramid fiber, a polyphenylene sulfide fiber, a polybenzoxazole fiber, a polybenzothiazole fiber, a polybenzimidazole fiber, a polyether ether ketone fiber, a polyarylate fiber, a polyimide fiber, a fluoride fiber, and a flame-resistant fiber so as to have a desired fiber length. These heat-resistant staple fibers include those conventionally known or manufactured according to well-known methods or methods based on these well-known methods, and all of them can be used. Here, the flame-resistant fiber is mainly a fiber manufactured by sintering an acrylic fiber at 200 to 500° C. in an active atmosphere such as air, that is, a precursor of carbon fiber. For example, a flame-resistant fiber manufactured by Asahi Kasei under the trade name of "LASTAN®" and a flame-resistant fiber manufactured by Toho Tenax under the trade name of "Pyromex®" can be mentioned.

Among these heat-resistant organic fibers, at least one type of organic fibers selected from the group consisting of an aramid fiber, a polyphenylene sulfide fiber, a polybenzoxazole fiber, a polyether ether ketone fiber, a polyarylate fiber, and a flame-resistant fiber is preferably used from the viewpoint of low shrinkability and workability. Particularly, an aramid fiber is preferably used.

The aramid fiber includes a para-aramid fiber and a meta-aramid fiber. Particularly, a para-aramid fiber is preferably used from the viewpoint of lower heat shrinkability. Examples of the para-aramid fiber to be used include commercially-available products such as a polyparaphenylene terephthalamide fiber (manufactured by E.I DU PONT and DU PONT-TORAY Co., Ltd. under the trade name of "KEVLAR®") and a co-poly-paraphenylene-3,4'-oxydiphenylene terephthalamide fiber (manufactured by TEIJIN under the trade name of "TECHNORA®").

Such an aramid fiber may have a film former, a silane coupling agent, and a surfactant on the surface or in the inside thereof. The amount of the solid matter of these surface treatment agents attached to the aramid fiber is preferably in the range of 0.01 to 20% by mass with respect to the amount of the aramid fiber.

The fiber length and fineness of the heat-resistant staple fiber are not particularly limited, and are appropriately determined according to compatibility with the thermoplastic staple fiber used together or the uses of a resultant sound-absorbing material. The fineness of the heat-resistant staple fiber is 0.1 to 50 dtex, preferably 0.3 to 30 dtex, more preferably 0.5 to 15 dtex, particularly preferably 1.0 to 10 dtex. The mechanism of flame retardancy in the non-woven fabric according to the present invention is not clear, but it can be considered that the heat-resistant staple fiber intertwisted with the thermoplastic staple fiber has the function of inhibiting combustion of the thermoplastic staple fiber. The fiber length of the heat-resistant staple fiber is not particularly limited, but is preferably 20 to 100 mm, particularly preferably 40 to 80 mm in view of flame retardancy and productivity.

The heat-resistant staple fibers mentioned above can be used singly or in combination of two or more types of them. For example, the heat-resistant staple fibers that are the same type but are different in fineness or fiber length may be mixed or the heat-resistant staple fibers that are different in type as well as in fineness or fiber length may be mixed. In either case, the mixing ratio of these staple fibers is not particularly limited, and can be appropriately determined according to the uses or purposes of a resultant sound-absorbing material.

The thermoplastic staple fiber and the heat-resistant staple fiber to be used in the present invention are preferably blended in a mass ratio of 95:5 to 55:45. If the ratio exceeds 95% by mass, the flame retardancy of the non-woven fabric is not sufficient so that dripping is likely to occur. That is, by allowing a web to contain 5% by mass or more of the heat-resistant staple fiber and intertwisting the heat-resistant staple fiber with the thermoplastic staple fiber, it is possible to prevent the thermoplastic staple fiber from being combusted and melted. On the other hand, if the ratio is less than 55% by mass, the non-woven fabric is excellent in flame retardancy but poor in workability that allows the non-woven fabric to have a desired size, thereby reducing economic efficiency. Therefore, from the viewpoint of flame retardancy and workability, the mass ratio of the thermoplastic staple fiber and the heat-resistant staple fiber is more preferably 88:12 to 55:45, furthermore preferably 85:15 to 55:45, most preferably 85:15 to 65:35.

In the present invention, in order to improve the abrasion resistance and sound-absorbing properties of the non-woven fabric, it is preferred that the thermoplastic staple fiber contain a fine-denier thermoplastic staple fiber. As a fine-denier thermoplastic staple fiber, at least one type of fibers selected from the above-mentioned polyester fiber, polypropylene fiber, and polyethylene fiber, a liner low-density polyethylene fiber, and an ethylene-vinyl acetate copolymer fiber can be mentioned.

The fineness of the fine-denier thermoplastic staple fiber to be used in the present invention is generally 0.1 to 15 dtex, preferably 0.5 to 6.6 detx, particularly preferably 1.1 to 3.3 dtex. If the fineness of the fine-denier thermoplastic staple fiber is too small, workability becomes poor. On the other hand, if the fineness of the fine-denier thermoplastic staple fiber is too large, sound-absorbing properties are impaired. The fiber length of the fine-denier thermoplastic staple fiber is not particularly limited, and can be appropriately determined according to compatibility with the heat-resistant staple fiber used and the uses of a resultant sound-absorbing material. However, the fiber length of the fine-denier thermoplastic staple fiber is generally preferably 10 to 100 mm, particularly preferably 20 to 80 mm.

In a case where the fine-denier thermoplastic staple fiber is mixed into a web, the mixing ratio of the fine-denier thermoplastic staple fiber is preferably 30 to 70% by mass, more preferably 30 to 50% by mass with respect to the total amount of the thermoplastic staple fiber.

In the present invention, the weight of the non-woven fabric is 150 to 800 g/m$^2$. If the weight of the non-woven fabric is too small, handleability during manufacturing becomes poor so that, for example, shape retention properties of a web layer are impaired. On the other hand, if the weight of the non-woven fabric is too large, energy required to intertwist fibers is increased or intertwisting of fibers is insufficiently carried out so that disadvantage such as deformation occurs when the non-woven fabric is processed.

It is to be noted that a web can be formed using a conventional web-forming machine according to a conventional web-forming method. For example, a mixture of the thermoplastic staple fiber and the heat-resistant staple fiber is subjected to carding in a carding machine to form a web.

The non-woven fabric to be preferably used in the present invention can be formed by, for example, needle punching or water jet punching a web obtained by blending the thermoplastic staple fiber with the heat-resistant staple fiber to intertwist and unite the fibers with each other. By subjecting the web to punching treatment to intertwist the fibers with each other, it is possible to improve the abrasion resistance of the non-woven fabric.

Either one or both of the surfaces of the web may be subjected to needle punching. At this time, if the needle punch density is too low, the abrasion resistance of the non-woven fabric becomes insufficient. On the other hand, if the needle punch density is too high, the bulk density and air volume ratio of the non-woven fabric are decreased, thereby deteriorating thermal insulation properties and sound-absorbing properties of the non-woven fabric. Therefore, the needle punch density is preferably 50 to 300 punches/cm$^2$, more preferably 50 to 100 punches/cm$^2$.

In the present invention, needle punching can be carried out using a conventional needle punch machine according to a conventional needle punch method.

Water jet punching can be carried out according to a conventional water jet punch method using, for example, a water jet punch machine for spraying high-pressure water streams of 90 to 250 kg/cm$^2$G from a plurality of nozzles having a diameter of 0.05 to 2.0 mm and aligned in a line or in a plurality of lines at intervals of 0.3 to 10 mm. The distance between the nozzles and a web is preferably about 1 to 10 cm.

The web subjected to needle punching or water jet punching may be dried in the conventional manner and then, if necessary, heat-setted.

In a case where the non-woven fabric is comprised of a staple fiber, if the bulk density thereof is too low, flame retardancy, thermal insulation, and sound absorbency are impaired. On the other hand, if the bulk density thereof is too high, flame retardancy, abrasion resistance, and workability are impaired. Therefore, it is necessary for the staple fiber non-woven fabric to have a bulk density of 0.01 to 0.2 g/cm$^3$. Preferably, the bulk density of the staple fiber non-woven fabric is 0.01 to 0.1 g/cm$^3$, more preferably 0.02 to 0.08 g/cm$^3$, even more preferably 0.02 to 0.05 g/cm$^3$. By controlling the bulk density of the non-woven fabric to control the ratio of air (oxygen) contained in the non-woven fabric within a certain range, it is possible to impart excellent flame retardancy, thermal insulation, and sound absorbency to the non-woven fabric.

Further, in the present invention, in a case where heat resistance or durability is of importance to the sound-absorbing material, the non-woven fabric is preferably comprised of a heat-resistant fiber. The heat-resistant fiber may be either a staple fiber or a filament. Examples of such a heat-resistant fiber include the above-mentioned heat-resistant organic fibers. In this case, the non-woven fabric is usually manufactured using such a heat-resistant fiber according to a well-known method.

In the present invention, a thicker non-woven fabric makes sound absorbency better, but the thickness of the non-woven fabric is preferably 2 to 100 mm, more preferably 3 to 50 mm, even more preferably 5 to 30 mm, from the viewpoint of, for example, economic efficiency, ease of handling, and a space to be reserved for the sound-absorbing material.

As described above, the sound-absorbing material according to the present invention has a layer structure comprising the non-woven fabric and the surface material. The surface material needs to have an air permeability of not more than 50 cc/cm$^2$/sec measured according to JIS L-1096. There is no lower limit to the air permeability of the surface material, but the air permeability is preferably 0.01 to 50 cc/cm$^2$/sec, particularly preferably 0.01 to 30 cc/cm$^2$/sec. If the air permeability exceeds 50 cc/cm$^2$/sec, the sound absorbency of the sound-absorbing material is impaired.

The constituent material of the surface material is not particularly limited, and for example, the above-mentioned materials for the non-woven fabric can be used. The surface material may be in the form of a fabric or a film. Examples of the fabric include non-woven fabrics (including clean paper and polyester paper), woven fabrics, and knitted fabrics. Examples of films include polyester films. The constituent fiber of such a fabric may be either a staple fiber or a filament. In a case where a fabric is used as the surface material, the surface material and the non-woven fabric layered on the surface material are made of the same material or different materials. For example, in a case where the sound-absorbing material according to the present invention is used as a vehicle interior material, the surface material and the non-woven fabric layered on the surface material are preferably made of the same material. This is because in this case, a large amount of the sound-absorbing material is used and the sound-absorbing material to be used as a vehicle interior material has to be recyclable. For example, in a case where the non-woven fabric contains a polyester material, the surface material is preferably made of a polyester.

Preferred examples of the surface material include spunbonded filament non-woven fabrics, dry-laid staple fiber non-woven fabrics, and wet-laid staple fiber non-woven fabrics. Particularly, spunbonded filament non-woven fabrics and wet-laid staple fiber non-woven fabrics are preferably used. Spunbonded filament non-woven fabrics are manufactured by a spunbond method. Among such spunbonded filament non-woven fabrics, those obtained by partially bonding fibers to each other by means of a thermal bonding manner to integrate a web are particularly preferable. As such a non-woven fabric, for example, a commercially-available spunbonded polyester non-woven fabric (manufactured by TORAY Industries, Inc. under the trade name of "Axtar") can be used. As a dry-laid staple fiber non-woven fabric, one manufactured by needle punching a web is preferably used.

Examples of the wet-laid staple fiber non-woven fabric include paper and felt made of chopped fibers, pulp, or staple fibers by a papermaking method.

In the present invention, a non-woven fabric comprised of a heat-resistant fiber with an LOI value of not less than 25 and a silicate mineral may be used as the surface material, and this non-woven fabric is preferably a wet-laid non-woven fabric. Such a preferred non-woven fabric can be manufactured using a heat-resistant fiber with an LOI value of not less than 25 and a silicate mineral according to a well-known wet method. The "heat-resistant fiber with an LOI value of not less than 25" may be a staple fiber, wherein the definition of the LOI value is the same as that described above. Examples of the heat-resistant fiber include the above-mentioned heat-resistant organic fibers. As the silicate mineral, mica is preferably used. Specific examples of the mica include white mica, bronze mica, black mica, and artificial bronze mica. The amount of the silicate mineral to be used is 5 to 70% by mass, preferably 10 to 40% by mass with respect to the amount of the surface material.

The preferred wet-laid non-woven fabric to be used as the surface material is preferably comprised of a heat-resistant staple fiber with an LOI value of not less than 25. Examples of such a heat-resistant staple fiber include the above-mentioned heat-resistant staple fibers. Among these heat-resistant staple fibers, an aramid staple fiber is preferably used, and a para-aramid staple fiber is more preferably used. Alternatively, the wet-laid non-woven fabric may be a non-woven fabric comprised of a heat-resistant staple fiber with an LOI value of not less than 25, and a silicate mineral. Such a wet-laid non-woven fabric is manufactured according to a well-known wet papermaking method using a heat-resistant staple fiber with an LOI value of not less than 25 or using a heat-resistant staple fiber with an LOI value of not less than 25 and a silicate mineral. As the silicate mineral, mica is preferably used. Specific examples of mica include white mica, bronze mica, black mica, and artificial bronze mica. The amount of the silicate mineral to be used is 5 to 70% by mass, preferably 10 to 40% by mass with respect to the amount of the surface material.

The non-woven fabric to be used as the surface material is preferably clean paper whose total number of dust particles with a diameter of 0.3 μm or larger generated in the dust generation test described later is not more than 500 particles/0.1 $ft^3$ (more preferably 100 particles/0.1 $ft^3$ or less). Such clean paper can be commercially available, and examples thereof include clean paper manufactured by Fuji Paper Co., Ltd. under the trade name of "OK Clean White", a spun-bonded filament non-woven fabric manufactured by TORAY Industries, Inc. under the trade name of "Axtar G2260-1S", and a wet-laid aramid staple fiber non-woven fabric manufactured by OJI PAPER Co., Ltd. under the trade name of "KEVLAR Paper".

The thickness of the surface material is not particularly limited, but is preferably about 0.01 to 2 mm, more preferably about 0.01 to 1 mm, even more preferably about 0.01 to 0.5 mm, most preferably about 0.03 to 0.1 mm. The mass of the surface material per unit area is preferably as light as possible, but is about 10 to 400 $g/m^2$, preferably about 20 to 400 $g/m^2$, more preferably about 20 to 100 $g/m^2$, from the viewpoint of strength.

In the present invention, the non-woven fabric can take various shapes such as polyhedron (e.g., hexahedrons such as a rectangular parallelepiped) and column and cylinder. In a case where the non-woven fabric of the sound-absorbing material according to the present invention is a polyhedron, the surface material may be layered on one of the faces of the polyhedron (e.g., a rectangular parallelepiped) or the surface material may be layered on two or more of the faces of the polyhedron. In a case where the non-woven fabric is in the shape of a column or a cylinder, the surface material is preferably layered on a curved face of the column or the cylinder.

The surface material and the non-woven fabric may be layered together in a state where they are not bonded to each other, but they are preferably layered together in a state where they are bonded to each other by a conventional bonding method. As a bonding method, bonding using resin rivets (e.g., "Bano'k" manufactured by Japan Bano'k), fusion, suturing, needle punching, bonding using adhesives, thermal embossing, ultrasonic bonding, sinter bonding using adhesive resins, or bonding with a welder can be mentioned. In addition to these methods, there can also be used a bonding method in which a low-melting point material such as a low-melting point net, a low-melting point film, or a low-melting point fiber provided between the surface material and the non-woven fabric is melted by heat treatment to bond the surface material and the non-woven fabric together via the low-melting point material. Here, the melting point of the low-melting point material is preferably lower than that of another fiber used for the non-woven fabric or the surface material by 20° C. or more. It is to be noted that in a case where sinter bonding is employed as the bonding method, a high-temperature adhesive resin powder (e.g., nylon 6, nylon 66, polyester) or a low-temperature adhesive resin powder (e.g., EVA (low-melting point ethylene-vinyl acetate copolymer)) is preferably used. In the case of bonding using adhesives, either thermoplastic adhesives or thermosetting adhesives can be used. In this case, for example, after a thermosetting epoxy resin is applied onto the surface material or the non-woven fabric, the surface material and the non-woven fabric are layered together and are then subjected to heat treatment to cure the resin.

A higher degree of bonding between the surface material and the non-woven fabric (a larger number of bonding points or a larger surface area for bonding) allows the surface material and the non-woven fabric to be more firmly bonded together, but the degree of bonding therebetween is too high, the sound absorption coefficient of a resultant sound-absorbing material is lowered. In a case where there is no bonding between the surface material and the non-woven fabric, the sound absorption coefficient of a resultant sound-absorbing material is enhanced, but problems such as peeling off in use and poor handling occur. From such a viewpoint, the number of bonding points between the surface material and the non-woven fabric is at least 1 point/$cm^2$ but preferably not more than 30 points/$cm^2$, more preferably not more than 20 points/$cm^2$, even more preferably not more than 10 points/$cm^2$. The surface area of the bonding point(s) is preferably as small as possible, because if the surface area of the bonding point(s) is too large, the sound absorption coefficient of a resultant sound-absorbing material is lowered. For example, when the total surface area of bonding points is defined as "B" and the total surface area of bonding points and non-bonding points is defined as "A+B", the ratio of the total surface area of bonding points (B) to the total surface area of bonding points and non-bonding points (A+B), that is, the ratio represented by the formula: $\{B/(A+B)\}\times 100$ (%) is preferably not more than 30%, more preferably not more than 20%, furthermore preferably not more than 10%. In order to decrease the number of bonding points or the bonding ratio, for example, a low-melting point material formed into a net shape or a small amount of low-melting point material particles having a relatively large particle size is preferably used as an adhesive.

In the sound-absorbing material according to the present invention, the surface material needs to be layered on at least one of the sides of the non-woven fabric, but may be layered on both sides of the non-woven fabric. Further, the sound-absorbing material according to the present invention may have a multilayer structure in which at least one or more layers of the non-woven fabric and at least one or more layers of the surface material are layered and united together. In this case, the number of layers is not particularly limited.

The sound-absorbing material according to the present invention may be colored with dyes or pigments if necessary. In a case where a colored sound-absorbing material is manufactured, spun-dyed yarn obtained by spinning a polymer mixed with a dye or pigment or fibers colored by various methods can be used. Alternatively, the sound-absorbing material itself may be colored with dyes or pigments.

If necessary, the sound-absorbing material according to the present invention may be coated or impregnated with an acrylic resin emulsion, or an acrylic resin emulsion or an acrylic resin solution containing a well-known flame retardant such as a phosphate-based flame retardant, a halogen-based flame retardant or a hydrated metal compound for the purpose of further improving the flame retardancy or abrasion resistance thereof.

The sound-absorbing material according to the present invention can be used for various applications by forming it so as to have a desired size or shape by, for example, a well-known method according to its purpose of use or application. The sound-absorbing material according to the present invention can be used for all applications requiring flame retardancy and sound absorbency. For example, the sound-absorbing material according to the present invention is suitably used for interior materials of transport facilities such as vehicles (e.g., cars and freight cars), boats and ships, and airplanes, and civil engineering/construction materials (e.g., wall materials and ceiling materials). Particularly, the use of the sound-absorbing material according to the present invention as the interior material of a vehicle engine room makes it possible to prevent the spread of fire in the event that a fire breaks out in an engine room and to prevent noise of the engine room from escaping out of the engine room. In addition, the sound-absorbing material according to the present invention can also be used for various applications such as vehicle ceiling materials, floor materials, rear packages, and door trims; dashboard insulators of cars, trains, and airplanes; electric products such as electric vacuum cleaners, exhaust fans, electric washing machines, electric refrigerators, freezers, electric cloth driers, electric mixers, electric juicers, air conditioners, hair driers, electric shavers, air cleaners, electric dehumidifiers, and electric lawn mowers; diaphragms for speakers; and civil engineering/construction machineries such as breakers (e.g., casing liners).

The sound-absorbing material according to the present invention obtained by using clean paper as the surface material, especially the sound-absorbing material comprising clean paper as the surface material and the non-woven fabric in which a polyester staple fiber is intertwisted with an aramid staple fiber is preferably used as a sound-absorbing material for mechanical equipment and air conditioning equipment in clean rooms and for buildings for clean rooms.

It is preferred that the rear surface of the sound-absorbing material according to the present invention (that is, the surface of the sound-absorbing material on the non-woven fabric side) or the side surface thereof is attached to a member such as a reflector or a fixation plate when the sound-absorbing material is used. Examples of the material of the "member" include metals such as aluminum, resins such as rubber, and wood. The shape of the "member" is not particularly limited, and the "member" may have either a frame shape or a casing shape. In the present invention, the "member" preferably a reflector. Hereinbelow, the reflector will be described.

Examples of the reflector include metal plates and resin plates. As a metal plate, a well-known metal plate can be used as long as it is made of a metal material and is formed so as to have a plate shape, and the kind of metal and the size of the metal plate are not particularly limited. Examples of such a metal plate include metal plates made of stainless steel, iron, titanium, nickel, aluminum, copper, cobalt, iridium, ruthenium, molybdenum, manganese, and alloys containing two or more of them and composites made of such a metal and carbon and formed so as to have a plate shape. As a resin plate, a well-known resin plate can be used as long as it is made of a resin and is formed so as to have a plate shape, and the kind of resin and the size, mechanical properties, and additives of the resin plate are not particularly limited. Examples of such a resin plate include synthetic resin plates, fiber reinforced resin plates, and rubber plates.

The synthetic resin plate is manufactured by forming a synthetic resin into a plate shape according to a well-known forming method. Examples of the synthetic resin include thermoplastic resins and thermosetting resins.

Examples of the thermoplastic resins include polyester resins such as polyethylene terephthalate (PET) resins, polybutylene terephthalate (PBT) resins, polytrimethylene terephthalate (PTT) resins, polyethylene naphthalate (PEN) resins, and liquid crystal polyester resins, polyolefin resins such as polyethylene (PE) resins, polypropylene (PP) resins, and polybutylene resins; styrene-based resins, polyoxymethylene (POM) resins, polyamide (PA) resins, polycarbonate (PC) resins, polymethyl methacrylate (PMMA) resins, polyvinyl chloride (PVC) resins, polyphenylene sulfide (PPS) resins, polyphenylene ether (PPE) resins, polyphenylene oxide (PPO) resins, polyimide (PI) resins, polyamideimide (PAI) resins, polyetherimide (PEI) resins, polysulfone (PSU) resins, polyethersulfone resins, polyketone (PK) resins, polyether ketone (PEK) resins, polyether ether ketone (PEEK) resins, polyarylate (PAR) resins, polyethernitrile (PEN) resins, phenol resins (e.g., novolac phenol resin plates), phenoxy resins, and fluoride resins, polystyrene-based, polyolefin-based, polyurethane-based, polyester-based, polyamide-based, polybutadiene-based, polyisoprene-based, and fluorine-based thermoplastic elastomers, and copolymer resins and modified resins thereof.

Examples of the thermosetting resins include phenol resins, epoxy resins, epoxy acrylate resins, polyester resins (e.g., unsaturated polyester resins), polyurethane resins, diallylphtahlate resins, silicone resins, vinylester resins, melamine resins, polyimide resins, polybismaleimide triazine (BT) resins, cyanate resins (e.g., cyanate ester resins), copolymer resins thereof, denatured resins thereof, and mixtures thereof.

The fiber reinforced resin plate is not particularly limited as long as it is composed of a fiber and a resin (e.g. the thermosetting resin mentioned above) and is formed so as to have a plate shape. As such a fiber reinforced resin plate, a well-known fiber reinforced resin plate can be used. Generally, such a fiber reinforced resin plate is manufactured according to a well-known method, that is, by impregnating a fiber or a fiber product with a prepreg (that is, with an uncured thermosetting resin) and then curing it by heating. The fiber to be used as a raw material may be either a staple fiber or a filament. In either case, the material fiber is generally manufactured using the above-mentioned synthetic resin according to a well-known method. Examples of the fiber product include yarns, braids, woven fabrics, knitted fabrics, and non-woven fabrics. These fiber products are generally manufactured using the above-mentioned fibers according to a well-known method. Preferred examples of the fiber reinforced resin plate include fiber reinforced resin plates composed of a carbon fiber and an epoxy resin (carbon fiber reinforced epoxy resin plates).

Examples of the rubber plate include natural rubber plates and synthetic rubber plates.

The resin plate described above may be an electromagnetic wave absorption plate. As an electromagnetic wave absorption plate, a well-known electromagnetic wave absorption plate such as an "electromagnetic wave shielding material formed into a plate shape" disclosed in Japanese Patent Application Laid-open No. 2003-152389 can be mentioned by way of example.

In a preferred case where the sound-absorbing material according to the present invention is attached to the member when used, for example, an aluminum plate is attached to the rear surface of the sound-absorbing material and an aluminum frame member is attached to the entire periphery of the sound-absorbing material to obtain a sound absorption panel. In this case, such a sound absorption panel can be placed, for example, inside the casing of mechanical equipment which generates noise or can be used as a partition.

EXAMPLES

Hereinbelow, the present invention will be described in more detail with reference to the following Examples and Comparative Examples, but the present invention is not limited to the Examples only. It is to be noted that characteristic values in the Examples and Comparative Examples were obtained according to the following methods.

(Air Permeability)

The air permeability of the surface material was measured by a fragile method according to JIS L-1096.

(Sound Absorption Coefficient)

The normal incidence sound absorption coefficients of the sound-absorbing material were measured at various frequencies using an automatic meter (manufactured by SOTEC Co., Ltd.) for normal incidence sound absorption coefficient by a "test method for normal incidence sound absorption of building materials by the tube method" according to JISA 1405. Measurement was carried out in such a manner that the sound-absorbing material was set in the meter so that the surface material thereof was directed toward a sound source.

(Thickness)

The thickness of each of the surface material and the non-woven fabric was measured under a load of 0.1 g/cm$^2$ using a compressive hardness tester (manufactured by Daiei Kagaku Seiki MFG. Co., Ltd.).

(Dry Heat Shrinkage at 280° C.)

The length of a fiber was measured before and after the fiber was heated at 280° C. for 30 minutes in the air, and the shrinkage of the fiber was determined based on the length of the fiber measured before heating.

(Degree of Dust Generation)

The degree of dust generation of the surface material was measured by a tumbling method according to JIS B 9923. First, a tumbler-type dust generation tester in a clean room was idled to check to see that there was no dust in the tester. Then, the surface material (20 cm×28.5 cm) which was not subjected to clean washing was placed in the tumbler-type dust generation tester (CW-HDT101), and the tester was operated at a drum rotation speed of 46 rpm. After the lapse of 1 minute from the beginning of operation, the number of dust particles was measured at a rate of 0.1 ft$^3$/min every 1 minute. The measurement of the number of dust particles for 1 minute was continuously carried out 10 times, and a mean value per minute was defined as the number of dust particles generated. As a dust counter is used 82-3200N, and the maximum suction air volume at the time when a filter was used was 2.2 L/min. Five samples, each having a size of 20 cm×28.5 cm, were used. The number of dust particles generated was expressed in terms of the number of dust particles generated in a 1 cm×1 cm sample. As shown in Table 1, the degree of dust generation was evaluated according to 5 rating criteria in terms of the total number of dust particles with a diameter of 0.3 μm or larger. Paper given a rating of 4 or 5 was defined as clean paper.

TABLE 1

| Rating | Total number of dust particles (particles/0.1 ft$^3$) |
|---|---|
| 5 | 100 or less |
| 4 | 101 to 500 |
| 3 | 501 to 1000 |
| 2 | 1001 to 5000 |
| 1 | 5001 or more |

Example 1

A para-aramid staple fiber manufactured by DU PONT-TORAY Co., Ltd. under the trade name of "KEVLAR®" (1.7 dtex×51 mm, dry heat shrinkage at 280° C.: 0.1% or less, LOI value: 29) and a polyethylene terephthalate (PET) staple fiber (1.7 dtex×51 mm) manufactured by TORAY Industries, Inc. were blended in a mass ratio of 30:70 to prepare a PET/aramid non-woven fabric having a thickness of 10 mm and a mass per unit area of 400 g/m$^2$ by needle punching. The bulk density of the obtained non-woven fabric was 0.04 g/cm$^3$.

At the same time, a 3 mm chopped fiber yarn of a para-aramid fiber having a single yarn fineness of 1.7 dtex ("KEVLAR®", manufactured by DU PONT-TORAY Co., Ltd.) and meta-aramid fiber ("Nomex®", manufactured by U.S.A. DU PONT) pulp were blended in amass ratio of 90:10, and were then subjected to a papermaking process and calendered to obtain an aramid paper having a thickness of 95 μm, a mass per unit area of 71 g/m$^2$, and an air permeability of 0.81 cc/cm$^2$/sec as a surface material. On the surface material, 75 g/m$^2$ of a low-melting point ethylene-vinyl acetate (EVA) copolymer powder (melting point: 80° C.) was sprinkled, and then the needle-punched PET/aramid non-woven fabric was layered on the surface material. The surface material and the non-woven fabric were sandwiched between metal wire gauzes, and then were subjected to heat treatment at 160° C. for 3 minutes to bond them together, thereby obtaining a sound-absorbing material of "(PET/aramid non-woven fabric)/aramid paper".

Example 2

A polyethylene terephthalate (PET) non-woven fabric having a thickness of 10 mm, a mass per unit area of 400 g/m$^2$, and a bulk density of 0.04 g/cm$^3$ was prepared by needle punching using a polyethylene terephthalate (PET) staple fiber (1.7 dtex×51 mm) manufactured by TORAY Industries, Inc. On the other hand, a spunbonded polyethylene terephthalate (PET) non-woven fabric ("Axtar® G2260", manufactured by TORAY Industries, Inc.) having a thickness of 560 μm, a mass per unit area of 260 g/m$^2$, and an air permeability of 11.5 cc/cm$^2$/sec was prepared as a surface material. In the same manner as in Example 1, the surface material was bonded to the needle-punched PET non-woven fabric to obtain a sound-absorbing material of "needle-punched PET non-woven fabric/spunbonded PET non-woven fabric".

Example 3

An aramid non-woven fabric having a thickness of 10 mm, a mass per unit area of 400 g/m$^2$, and a bulk density of 0.04 g/cm$^3$ was obtained by needle-punching using only the same para-aramid staple fiber ("KEVLAR®") as used in Example 1. As a surface material, the same aramid paper as used in Example 1 was prepared. In the same manner as in Example 1, the aramid paper as a surface material and the aramid non-woven fabric were bonded together to obtain a sound-absorbing material of "aramid non-woven fabric/aramid paper".

Comparative Example 1

A sound-absorbing material was obtained in the same manner as in Example 1 except that the aramid paper was omitted. That is, only a non-woven fabric containing a KEVLAR® staple fiber and a polyethylene terephthalate (PET) staple fiber in a mass ratio of 30:70 was prepared.

Comparative Example 2

A commercially-available meltblown non-woven fabric ("Thinsulate®", manufactured by Sumitomo 3M Ltd.) in which polypropylene (PP) and polyethylene terephthalate (PET) are blended in a mass ratio of 65:35 was prepared. The meltblown non-woven fabric had a thickness of 10 mm and a mass per unit area of 240 g/m$^2$.

The properties of each of the sound-absorbing materials and relation between frequency and sound absorption coefficient are shown in Table 2. As is clear from Table 2, all the sound-absorbing materials of the Examples 1 to 3 are superior in sound absorbency to those of the Comparative Examples.

TABLE 2

| | | Example 1 | Example 2 | Example 3 | Comparative Example 1 | Comparative Example 2 |
|---|---|---|---|---|---|---|
| Non-woven fabric | Kind of fiber | PET/aramid (70/30) | PET | Aramid | PET/aramid (70/30) | PP/PET (70/30) |
| | Weight (g/m$^2$) | 400 | 400 | 400 | 400 | 240 |
| | Thickness (mm) | 10 | 10 | 10 | 10 | 10 |
| | Bulk density (g/cm$^3$) | 0.04 | 0.04 | 0.04 | 0.04 | — |
| Surface material | Kind | Aramid paper | Spunbonded PET non-woven fabric | Aramid paper | — | — |
| | Weight (g/m$^2$) | 71 | 260 | 71 | — | — |
| | Thickness (μm) | 95 | 560 | 95 | — | — |
| | Air Permeability (cc/cm$^2$/sec) | 0.81 | 11.5 | 0.81 | — | — |
| Normal incidence sound absorption coefficient | ⅓ octave band frequency (Hz) | 11.0 | 11.0 | 10.3 | 8.2 | 6.3 |
| | 500 | | | | | |
| | 630 | 11.3 | 19.1 | 11.8 | 10.1 | 7.5 |
| | 800 | 20.5 | 32.7 | 20.3 | 14.6 | 10.9 |
| | 1000 | 33.3 | 57.0 | 32.5 | 19.5 | 17.1 |
| | 1250 | 44.6 | 76.1 | 43.7 | 25.1 | 25.7 |
| | 1600 | 66.2 | 86.8 | 72.5 | 31.7 | 34.9 |
| | 2000 | 96.5 | 86.8 | 98.8 | 40.3 | 47.2 |

Example 4

A polyethylene terephthalate (PET) staple fiber (1.7 dtex×44 mm) manufactured by TORAY Industries, Inc., a polyethylene terephthalate (PET) staple fiber (6.6 dtex×51 mm) manufactured by TORAY Industries, Inc., and a low-melting point yarn manufactured by TORAY Industries, Inc. under the trade name of "SAFMET" (melting point: 110° C., 4.4 dtex×51 mm) were blended in a mass ratio of 60:20:20, and were then subjected to a carding step to obtain a web. Then, the web was needle-punched to obtain a non-woven fabric. The non-woven fabric was subjected to heat treatment at 150° C. for 3 minutes to melt the low-melting point yarn so that the other polyester staple fibers were partially bonded together, thereby obtaining a non-woven fabric having a thickness of 10 mm, a mass per unit area of 400 g/m$^2$, and a bulk density of 0.04 g/cm$^3$.

On the thus obtained non-woven fabric, 10 g/m$^2$ of an EVA powder "2030-M" manufactured by Tokyo Printing Ink MFG. Co., Ltd. was sprinkled, and was then continuously heated at 140° C. for 1 minute. Then, clean paper manufactured by Fuji Paper Co., Ltd. under the trade name of "Clean Paper OK clean white" (thickness: 90 μm, weight: 70 g/m$^2$, air permeability: 0.15 cc/cm$^2$/sec) was layered as a surface material onto the non-woven fabric, and then they were bonded together by pressing using a cooling roll to obtain a sound-absorbing material. The dust generation properties of the clean paper used as a surface material are shown below. The degree of dust generation of the clean paper was given a rating of 5.

TABLE 3

| | Particle diameter (μm) | | | | | | |
|---|---|---|---|---|---|---|---|
| | 0.3 | 0.5 | 1.0 | 2.0 | 5.0 | 10.0 | Total |
| Number of particles | 11 | 8 | 11 | 9 | 2 | 0 | 41 |

Example 5

The same non-woven fabric as used in Example 1 and a spunbonded polyethylene terephthalate (PET) filament non-woven fabric manufactured by TORAY Co., Ltd. under the trade name of "Axtar® G2260-1S" (thickness: 620 μm, weight: 260 g/m$^2$, air permeability: 11 cc/cm$^2$/sec) as a surface material were bonded together in the same manner as in Example 1 to obtain a sound-absorbing material. The dust generation properties of the surface material are shown below. The degree of dust generation of the surface material was given a rating of 4.

TABLE 4

| | Particle diameter (μm) | | | | | | |
|---|---|---|---|---|---|---|---|
| | 0.3 | 0.5 | 1.0 | 2.0 | 5.0 | 10.0 | Total |
| Number of particles | 100 | 50 | 102 | 39 | 8 | 1 | 318 |

Example 6

The same non-woven fabric as used in Example 1 and 100% KEVLAR® paper manufactured by OJI PAPER Co., Ltd. (thickness: 95 μm, weight: 72 g/m$^2$, air permeability: 0.93 cc/cm$^2$/sec) as a surface material were bonded together to obtain a sound-absorbing material. The non-woven fabric and the surface material were bonded together using a NISSEKI Conwed net ON5058 manufactured by NISSEKI PLASTO Co., Ltd. Specifically, the Conwed net was placed on the non-woven fabric, and then they were heated at 150° C. for 1 minute to melt the surface of the Conwed net. Then, the surface material was placed on the Conwed net and they were compressed with a cooling roll to bond the surface material and the non-woven fabric together.

The non-woven fabric and the surface material were bonded via the meshes of the Conwed net having a mesh size of 8 mm. The ratio of the total surface area of bonding points of the KEVLAR® paper and the non-woven fabric via the Conwed net (B) to the total surface area of the bonding points and non-bonding points (A+B), that is, the ratio represented by the formula: $\{B/(A+B)\}\times 100$ (%) was 2%.

Example 7

The same non-woven fabric as used in Example 1 and the same aramid paper as used in Example 1 as a surface material were bonded together to obtain a sound-absorbing material. The non-woven fabric and the surface material were bonded together using a double-faced tape. Specifically, the double-faced tape was stuck to the surface material, and the non-woven fabric was layered thereon. Then, the surface material and the non-woven fabric were compressed using a roll so as to entirely and firmly come into contact with each other.

The ratio of the total surface area of bonding points (B) to the total surface area of bonding points and non-bonding points (A+B) was 100%.

The normal incidence sound absorption coefficients of the sound-absorbing materials of the Examples 4 to 7 are shown in Table 5.

TABLE 5

| | | Example 4 | Example 5 | Example 6 | Example 7 |
|---|---|---|---|---|---|
| Non-woven fabric | Kind of fiber | Blended PET | PET/aramid (70/30) | PET/aramid (70/30) | PET/aramid (70/30) |

TABLE 5-continued

| | | Example 4 | Example 5 | Example 6 | Example 7 |
|---|---|---|---|---|---|
| | Weight (g/m$^2$) | 400 | 400 | 400 | 400 |
| | Thickness (mm) | 10 | 10 | 10 | 10 |
| | Bulk density (g/cm$^3$) | 0.04 | 0.04 | 0.04 | 0.04 |
| Surface material | Kind | Commercially available clean paper | Spun-bonded PET non-woven fabric | KEVLAR® paper | Aramid paper |
| | Weight (g/m$^2$) | 70 | 260 | 72 | 71 |
| | Thickness (μm) | 90 | 620 | 95 | 95 |
| | Air permeability (cc/cm$^2$/sec) | 0.15 | 11 | 0.93 | 0.81 |
| Normal Incidence sound absorption coefficient | ⅓ octave band frequency (Hz) | 3.7 | 3.6 | 4.3 | 4.5 |
| | 100 | | | | |
| | 125 | 3.0 | 3.0 | 3.9 | 4.3 |
| | 160 | 3.4 | 3.5 | 4.0 | 4.0 |
| | 200 | 3.6 | 3.8 | 4.9 | 4.4 |
| | 250 | 4.2 | 5.5 | 5.8 | 5.2 |
| | 315 | 3.3 | 4.8 | 5.1 | 4.9 |
| | 400 | 5.5 | 7.1 | 7.3 | 10.0 |
| | 500 | 9.2 | 11.0 | 11.0 | 13.3 |
| | 630 | 8.9 | 19.1 | 11.4 | 24.5 |
| | 800 | 13.8 | 32.7 | 19.2 | 37.1 |
| | 1000 | 19.6 | 57.0 | 26.0 | 38.8 |
| | 1250 | 33.1 | 76.1 | 44.9 | 56.9 |
| | 1600 | 53.5 | 86.8 | 69.1 | 53.6 |
| | 2000 | 84.9 | 86.8 | 96.0 | 70.3 |

Example 8

In the same manner as in Example 1, the same aramid paper as used in Example 1 was bonded as a surface material to one of the surfaces of the same non-woven fabric as used in Example 1 to obtain a sample. Further, the same surface material as used in Example 1 (that is, aramid paper) was layered onto the surface of the non-woven fabric of the sample, that is, onto the surface opposite to the surface of the surface material of the sample, and then they were bonded together by heating in the same manner as in Example 1, thereby obtaining a sound-absorbing material of "aramid paper/(PET/aramid non-woven fabric)/aramid paper".

(Sound Transmission Loss Test)

The sound transmission losses of the sound-absorbing materials obtained in Examples 1 and 8 were measured according to JIS A 1416. The measurement results are shown in Table 6.

TABLE 6

| | | Frequency (Hz) | | | | | | | |
|---|---|---|---|---|---|---|---|---|---|
| | | 500 | 1000 | 2000 | 3150 | 4000 | 5000 | 6300 | 8000 |
| Sound transmission loss (dB) | Example 1 | 8.5 | 14.2 | 7.9 | 8.7 | 10.5 | 13.3 | 16.5 | 19.5 |
| | Example 8 | 8.6 | 14.0 | 8.3 | 11.8 | 15.1 | 20.1 | 24.9 | 28.7 |

Example 9

As a surface material, KEVLAR® paper containing mica (manufactured by Du Pont Teijin Advanced Papers) (thickness: 75 μm, weight: 86 g/m$^2$, air permeability: 0 cc/cm$^2$/sec) manufactured by papermaking using a mixture of a 5 mm chopped fiber yarn of para-aramid fiber ("KEVLAR®" manufactured by DuPont Teijin Advanced Papers, Ltd.) having a single yarn fineness of 1.7 dtex and mica as a silicate mineral was prepared. The surface material was bonded to the same non-woven fabric as used in Example 1, in which a KEVLAR® staple fiber and a polyethylene terephthalate (PET) staple fiber were blended in a mass ratio of 30:70 (thickness: 10 mm, weight: 400 g/m$^2$), in the same manner as in Example 1 using a low-melting point powder, thereby obtaining a sound-absorbing material with KEVLAR® paper containing mica. The normal incidence sound absorption coefficients of this sound-absorbing material were measured, and the measurement results are shown in Table 7.

Flame resistance test was performed on the sound-absorbing material according to the UL-94 Vertical burning test. A gas burner having a nozzle with an outer diameter of 19 mm and an inner diameter of 16.5 mm was used, and the length of a gas flame was adjusted to 140 mm. The sound-absorbing material was held in the gas flame at the position of a flame length of 100 mm for 4 minutes in such a manner that the sound-absorbing material was perpendicular to the flame (at this time, the surface material was placed on the flame side) to check whether a hole was produced in the surface material and the non-woven fabric. As a result, no hole was observed in both the surface material and non-woven fabric layers of the sound-absorbing material.

Example 10

A polyethylene terephthalate (PET) staple fiber (1.7 dtex×44 mm) manufactured by TORAY Industries, Inc., a polyethylene terephthalate (PET) staple fiber (6.6 dtex×51 mm) manufactured by TORAY Industries, Inc., and a low-melting point yarn manufactured by TORAY Industries, Inc. under the trade name of "SAFMET" (melting point: 110° C., 4.4 dtex×51 mm) were blended in a mass ratio of 60:20:20, and were then needle-punched to prepare a non-woven fabric having a thickness of 10 mm, a mass per unit area of 200 g/m$^2$, and a bulk density of 0.02 g/cm$^3$.

As a surface material, "100% polyester paper" (thickness: 90 μm, weight: 54 g/m$^2$, air permeability: 0.9 cc/cm$^2$/sec) manufactured by OJI PAPER Co., Ltd. was prepared, and the surface material was bonded to the non-woven fabric in the same manner as in Example 1 using a low-melting point EVA powder to obtain a sound-absorbing material of "polyethylene terephthalate (PET) non-woven fabric/polyester paper". The normal incidence sound absorption coefficients of this sound-absorbing material were measured, and the measurement results are shown in Table 7.

Example 11

A polyethylene terephthalate (PET) staple fiber (1.7 dtex×44 mm) manufactured by TORAY Industries, Inc., a polyethylene terephthalate (PET) staple fiber (6.6 dtex×51 mm) manufactured by TORAY Industries, Inc., and a low-melting point yarn manufactured by TORAY Industries, Inc. under the trade name of "SAFMET" (melting point: 110° C., 4.4 dtex×51 mm) were blended in amass ratio of 60:20:20, and were then subjected to a carding step to obtain a web. The web was needle-punched to obtain a non-woven fabric. The non-woven fabric was heated at 150° C. for 3 minutes to melt the low-melting point yarn so that other polyester staple fibers were partially bonded together, thereby obtaining a polyethylene terephthalate (PET) non-woven fabric having a thickness of 10 mm, a mass per unit area of 200 g/m$^2$, and a bulk density of 0.02 g/cm$^3$.

At the same time, a chopped fiber yarn (1.7 dtex×5 mm) of a para-aramid fiber ("KEVLAR®", manufactured by DU PONT-TORAY Co., Ltd.) and meta-aramid fiber ("Nomex®", manufactured by U.S.A. DU PONT) pulp were blended in a mass ratio of 95:5, and were then subjected to a papermaking process and calendered to obtain an aramid paper having a thickness of 70 μm, a mass per unit area of 36 g/m$^2$, and an air permeability of 20.5 cc/cm$^2$/sec as a surface material. The surface material and the non-woven fabric were bonded together in the same manner as in Example 1 to obtain a sound-absorbing material.

Two sheets of the thus obtained sound-absorbing material were layered together, and the aramid paper composed of KEVLAR® and Nomex® used in Example 1 (thickness: 95 μm, weight: 71 g/m$^2$, air permeability: 0.81 cc/cm$^2$/sec) was further placed undermost to measure the normal incidence sound absorption coefficients thereof. The measurement results are shown in Table 7.

TABLE 7

| | | Example 9 | Example 10 | Example 11 |
|---|---|---|---|---|
| Non-woven fabric | Kind of fiber | PET/aramid (70/30) | Blended PET | Blended PET (two layers) |
| | Weight (g/m$^2$) | 400 | 200 | 200/200 |
| | Thickness (mm) | 10 | 10 | 10/10 |
| | Bulk density (g/cm$^3$) | 0.04 | 0.02 | 0.02/0.02 |
| Surface material | Type | KEVLAR paper containing mica | Polyester paper | Aramid paper (three layers) |
| | Weight (g/m$^2$) | 86 | 54 | 36/36/71 |
| | Thickness (μm) | 75 | 90 | 70/70/95 |

TABLE 7-continued

| | | Example 9 | Example 10 | Example 11 |
|---|---|---|---|---|
| | Air permeability (cc/cm$^2$/sec) | 0 | 0.90 | 20.5/20.5/0.81 |
| Normal incidence sound absorption coefficient | ⅓ octave band frequency (Hz) | 3.4 | 4.5 | 4.3 |
| | 100 | | | |
| | 125 | 2.8 | 3.4 | 3.4 |
| | 160 | 3.2 | 4.3 | 3.9 |
| | 200 | 4.5 | 5.3 | 6.1 |
| | 250 | 5.8 | 7.8 | 10.3 |
| | 315 | 5.5 | 7.1 | 9.7 |
| | 400 | 8.7 | 10.6 | 16.1 |
| | 500 | 11.1 | 10.8 | 21.0 |
| | 630 | 17.6 | 14.4 | 28.9 |
| | 800 | 28.3 | 25.8 | 42.6 |
| | 1000 | 53.0 | 40.2 | 60.1 |
| | 1250 | 78.3 | 45.6 | 78.9 |
| | 1600 | 85.7 | 55.7 | 93.2 |
| | 2000 | 88.2 | 76.1 | 98.4 |

Comparative Example 3

A 100% polyethylene terephthalate (PET) non-woven fabric having a thickness of 2.5 mm, a mass per unit area of 100 g/cm$^2$, and a bulk density of 0.025 g/cm$^3$ was obtained using the same fibers as used in Example 4, at the same blending ratio as in Example 4, and in the same manner as in Example 4. The same surface material (that is, aramid paper) as used in Example 1 was bonded to the non-woven fabric in the same manner as in Example 1 to obtain a sound-absorbing material.

Comparative Example 4

A 100% polyethylene terephthalate (PET) non-woven fabric having a thickness of 5 mm, a mass per unit area of 45 g/cm$^2$, and a bulk density of 0.009 g/cm$^3$ was obtained using the same fibers as used in Example 4, at the same blending ratio as in Example 4, and in the same manner as in Example 4. The same surface material (that is, aramid paper) as used in Example 1 was bonded to the non-woven fabric in the same manner as in Example 1 to obtain a sound-absorbing material.

Comparative Example 5

A 100% polyethylene terephthalate (PET) non-woven fabric having a thickness of 25 mm, a mass per unit area of 900 g/cm$^2$, and a bulk density of 0.036 g/cm$^3$ was obtained using the same fibers as used in Example 4, at the same blending ratio as in Example 4, and in the same manner as in Example 4. The same surface material (that is, aramid paper) as used in Example 11 was bonded to the non-woven fabric in the same manner as in Example 1 to obtain a sound-absorbing material.

Comparative Example 6

A 100% aramid fiber wet-laid non-woven fabric having a thickness of 5.5 mm, a mass per unit area of 1582 g/m$^2$, and a bulk density of 0.29 g/cm$^3$ was obtained by papermaking using "KEVLAR®" pulp manufactured by U.S.A. DU PONT. The same surface material as used in Example 1 was bonded to the non-woven fabric in the same manner as in Example 1 to obtain a sound-absorbing material.

Comparative Example 7

A 100% polyethylene terephthalate (PET) non-woven fabric having a thickness of 10 mm, a mass per unit area of 200 g/cm$^2$, and a bulk density of 0.02 g/cm$^3$ was obtained using the same fibers as used in Example 4, at the same blending ratio as in Example 4, and in the same manner as in Example 4. A 100% polyethylene terephthalate (PET) surface material having a thickness of 410 μm, a mass per unit area of 59 g/m$^2$, and an air permeability of 93 cc/cm$^2$/sec was obtained using the same fibers as used for the non-woven fabric of the Example 4, in the same blending ratio as in Example 4 in the usual manner, that is, by blending and needle-punching the fibers. The thus obtained non-woven fabric and the surface material were bonded together in the same manner as in Example 1 using a low-melting point powder to obtain a sound-absorbing material.

The normal incidence sound absorption coefficients of the sound-absorbing materials obtained in Comparative Examples 3 to 7 are shown in Table 8.

TABLE 8

| | | Comparative Example 3 | Comparative Example 4 | Comparative Example 5 | Comparative Example 6 | Comparative Example 7 |
|---|---|---|---|---|---|---|
| Non-woven fabric | Kind of fiber | Blended PET | Blended PET | Blended PET | Blended PET | Blended PET |
| | Weight (g/m$^2$) | 100 | 45 | 900 | 1582 | 200 |
| | Thickness (mm) | 2.5 | 5 | 25 | 5.5 | 10 |
| | Bulk density (g/cm$^3$) | 0.04 | 0.009 | 0.036 | 0.29 | 0.02 |
| Surface material | Kind | Aramid paper | Aramid paper | Aramid paper | Aramid paper | Needle-punched PET non-woven fabric |
| | Weight (g/m$^2$) | 71 | 71 | 36 | 71 | 59 |
| | Thickness (μm) | 95 | 95 | 70 | 95 | 410 |
| | Air permeability (cc/cm$^2$/sec) | 0.81 | 0.81 | 20.5 | 0.81 | 93 |
| Normal Incidence sound absorption coefficient | ⅓ octave band frequency (Hz) | 3.1 | 3.7 | 5.2 | 4.4 | 5.3 |
| | 100 | | | | | |
| | 125 | 3.0 | 2.5 | 4.2 | 3.9 | 4.6 |
| | 160 | 2.9 | 3.0 | 4.9 | 4.1 | 4.7 |
| | 200 | 3.3 | 3.4 | 6.0 | 5.9 | 5.4 |
| | 250 | 3.3 | 3.4 | 11.1 | 5.9 | 6.2 |

TABLE 8-continued

| | Comparative Example 3 | Comparative Example 4 | Comparative Example 5 | Comparative Example 6 | Comparative Example 7 |
|---|---|---|---|---|---|
| 315 | 2.3 | 2.4 | 17.1 | 5.1 | 5.3 |
| 400 | 3.4 | 3.6 | 28.1 | 6.6 | 7.2 |
| 500 | 4.1 | 4.0 | 37.6 | 8.5 | 9.2 |
| 630 | 3.8 | 3.4 | 49.8 | 8.8 | 10.3 |
| 800 | 4.9 | 4.3 | 58.8 | 12.0 | 10.9 |
| 1000 | 7.2 | 5.9 | 77.4 | 16.6 | 13.8 |
| 1250 | 9.6 | 7.9 | 84.7 | 23.3 | 16.8 |
| 1600 | 16.1 | 10.4 | 90.5 | 38.2 | 21.9 |
| 2000 | 28.6 | 31.0 | 92.0 | 27.0 | 32.8 |

As is clear from Tables 7 and 8, the sound-absorbing material of the Example 11 had a higher effect of absorbing relatively low frequency sound (that is, sound of 1000 Hz or less, especially 500 Hz or less) as compared to other sound-absorbing materials because the thickness of the sound-absorbing material of the Example 11 was larger due to its layered structure.

Further, the sound-absorbing material whose non-woven fabric had a relatively light weight (Comparative Example 3) had low sound absorption coefficients at both low and high frequencies. On the other hand, the sound-absorbing material whose non-woven fabric had a relatively heavy weight (Comparative Example 5) had a high effect of absorbing sound due to an increased thickness, but its heavy weight caused problems in handleability and workability. The sound-absorbing material whose non-woven fabric had a relatively low bulk density (Comparative Example 4) had low sound absorption coefficients, and such a sound-absorbing material was likely to collapse due to application of loads. The sound-absorbing material whose non-woven fabric had a relatively high bulk density (Comparative Example 6) was poor in handleability because it was too rigid and heavy.

Further, the sound-absorbing material whose surface material had an air permeability exceeding 50 cc/cm$^2$/sec (that is, the sound-absorbing material of the Comparative Example 7) did not have an improved sound absorbency even if the surface material was bonded to the non-woven fabric because the air permeability of the surface material was too large.

INDUSTRIAL APPLICABILITY

The sound-absorbing material according to the present invention is useful as a sound-absorbing material to be used in the fields of electric products such as air conditioners, electric refrigerators, electric washing machines, audiovisual apparatuses, and electric lawn mowers; transport facilities such as vehicles, boats and ships, and airplanes; and building materials such as building wall materials.

The invention claimed is:

1. A sound-absorbing material, wherein:

(a) a non-woven fabric with a mass per unit area of 150 to 800 g/m$^2$ and a bulk density of 0.01 to 0.2 g/cm$^3$ and (b) a surface material with an air permeability of not more than 50 cc/cm$^2$/sec measured according to JIS L-1096 are layered by bonding, and the number of the bonding points of the non-woven fabric and the surface material is not more than 30 points/cm$^2$, and the ratio of the total surface area of the bonding points to the total surface area of the bonding points and the non-bonding points is not more than 30%, and (b) the surface material is a spun bonded non-woven fabric or a wet-laid non-woven staple fabric.

2. The sound-absorbing material according to claim 1, wherein the non-woven fabric (a) is a fabric in which a thermoplastic staple fiber and a heat resistant staple fiber with an LOI value of not less than 25 are intertwisted.

3. The sound-absorbing material according to claim 2, wherein the weight ratio of the thermoplastic staple fiber and the heat resistant staple fiber is in a range of 95:5 to 55:45.

4. The sound-absorbing material according to claim 2, wherein the weight ratio of the thermoplastic staple fiber and the heat resistant staple fiber is in a range of 85:15 to 55:45.

5. The sound-absorbing material according to claim 2, wherein the thermoplastic staple fiber is at least one kind of staple fiber selected from the group consisting of a polyester fiber, a polypropylene fiber and a nylon fiber.

6. The sound-absorbing material according to claim 2, wherein the heat resistant staple fiber is at least one kind of staple fiber selected from the group consisting of an aramid fiber, a polyphenylene sulfide fiber, a polybenzoxazole fiber, a polybenzothiazole fiber, a polybenzimidazole fiber, a polyether ether ketone fiber, a polyarylate fiber, a polyimide fiber, a fluoride fiber and a flame resistant fiber.

7. The sound-absorbing material according to claim 2, wherein the thermoplastic staple fiber is a polyester staple fiber and the heat resistant staple fiber is an aramid staple fiber.

8. The sound-absorbing material according to claim 1, wherein the wet-laid non-woven fabric is comprised of a heat resistant staple fiber with an LOI value of not less than 25.

9. The sound-absorbing material according to claim 1, wherein the wet-laid non-woven fabric is comprised of a heat resistant staple fiber with an LOI value of not less than 25 and a silicate mineral.

10. The sound-absorbing material according to claim 9, wherein the silicate mineral is mica.

11. The sound-absorbing material according to claim 8, wherein the heat resistant staple fiber is an aramid staple fiber.

12. The sound-absorbing material according to claim 1, wherein the surface material (b) has a dust generation number of not more than 500 particles/0.1 ft$^3$ of particles with a diameter of not less than 0.3 μm measured by the tumbling method according to JIS B-9923 6.2(1.2).

13. The sound-absorbing material according to claim 1, wherein the non-woven fabric (a) and the surface material (b) are comprised of the same kind of synthetic fiber.

14. The sound-absorbing material according to claim 1, wherein the non-woven fabric (a) is in the shape of a polyhedron and the surface material (b) is layered on two or more faces of the polyhedron.

15. The sound-absorbing material according to claim 14, wherein the non-woven fabric (a) is in the shape of a hexahedron and the surface material (b) is layered on both side faces of the hexahedron.

16. The sound-absorbing material according to claim 1, wherein the non-woven fabric (a) is in the shape of a column or a cylinder and the surface material (b) is layered on the curved face of the column or the cylinder.

17. The sound-absorbing material according to claim 1 having a multilayer structure comprising at least one or more layers of each of the non-woven fabric (a) and the surface material (b), wherein the both layers are united.

18. The sound-absorbing material according to claim 1, which is used as a vehicle interior material or a vehicle exterior material.

19. The sound-absorbing material according to claim 1, which is used as a sound-absorbing material for a lawn mower.

20. The sound-absorbing material according to claim 1, which is used as a sound-absorbing material for a breaker.

21. The sound-absorbing material according to claim 1, wherein the constituent fiber of (b) the surface material is a thermoplastic fiber having fineness of 0.5 to 30 dtex.

22. The sound-absorbing material according to claim 1, wherein (a) the non-woven fabric is produced by needle punch method or water jet method.

* * * * *